US009950491B2

(12) United States Patent
Wetsch et al.

(10) Patent No.: US 9,950,491 B2
(45) Date of Patent: Apr. 24, 2018

(54) FLEXIBLE NOZZLE FOR INFLATION AND SEALING DEVICE

(71) Applicant: PREGIS INNOVATIVE PACKAGING LLC, Deerfield, IL (US)

(72) Inventors: Thomas D. Wetsch, St. Charles, IL (US); Christopher M. Rains, New Lenox, IL (US)

(73) Assignee: PREGIS INNOVATIVE PACKAGING LLC, Deerfield, IL (US)

( * ) Notice: Subject to any disclaimer, the term of this patent is extended or adjusted under 35 U.S.C. 154(b) by 405 days.

(21) Appl. No.: 14/678,718

(22) Filed: Apr. 3, 2015

(65) Prior Publication Data

US 2015/0283781 A1 Oct. 8, 2015

Related U.S. Application Data

(60) Provisional application No. 61/975,648, filed on Apr. 4, 2014.

(51) Int. Cl.
*B31D 5/00* (2017.01)

(52) U.S. Cl.
CPC ..... *B31D 5/0073* (2013.01)

(58) Field of Classification Search
CPC ..... B31D 5/0073
USPC ..... 53/79, 403
See application file for complete search history.

(56) References Cited

U.S. PATENT DOCUMENTS 2,368,624 A * 2/1945 Walton ..... B65B 31/044 141/65
3,042,319 A 7/1962 Burd
3,430,720 A * 3/1969 Carter et al. ..... B65B 1/32 177/1
3,624,982 A * 12/1971 Marietta, Jr. ..... B65B 31/044 53/138.4
4,114,230 A * 9/1978 MacFarland ..... A47L 7/04 137/223
5,836,522 A 11/1998 Przystawik
6,116,000 A * 9/2000 Perkins et al. ..... B31D 5/0073 53/139.5
6,209,286 B1 4/2001 Perkins et al.
6,561,236 B1 5/2003 Sperry et al.
(Continued)

OTHER PUBLICATIONS

International Search Report and Written Opinion for related International Patent Application No. PCT/US2015/024324, dated Jul. 2, 2015 (11 pages).

*Primary Examiner* — Stephen F Gerrity
(74) *Attorney, Agent, or Firm* — Dorsey & Whitney LLP

(57) ABSTRACT

A flexible structure inflation and sealing assembly that can comprise a driver configured for engaging the flexible structure to drive the structure in a downstream direction longitudinally along a material path and a nozzle configured for reception in an inflation channel that extends through the flexible structure. At least a portion of the nozzle is flexible and is operable to adjust to the direction and angle that the flexible structure approaches from. The flexible portion may align with a tip of the nozzle in one axis and the opposite end of the nozzle in a second axis thereby allowing for misalignment of the flexible structure as it engages the nozzle and is directed to a pinch area.

18 Claims, 12 Drawing Sheets

(56) References Cited

U.S. PATENT DOCUMENTS

| | | | | |
|---|---|---|---|---|
| 7,220,476 | B2 * | 5/2007 | Sperry et al. | B31D 5/0073 206/522 |
| 2007/0209154 | A1 * | 9/2007 | Griffith et al. | A47L 5/30 15/415.1 |
| 2007/0278123 | A1 * | 12/2007 | Oremus et al. | B31D 5/0073 206/522 |
| 2010/0200169 | A1 | 8/2010 | Sperry et al. | |
| 2012/0227892 | A1 | 9/2012 | Wetsch et al. | |
| 2012/0247595 | A1 | 10/2012 | Raftis et al. | |
| 2013/0055685 | A1 * | 3/2013 | Itabashi | G03G 15/0879 53/467 |
| 2014/0261880 | A1 * | 9/2014 | Nakamura et al. | G07F 13/00 141/91 |
| 2015/0000070 | A1 * | 1/2015 | Liu et al. | A47L 5/14 15/330 |
| 2016/0122112 | A1 * | 5/2016 | Nevo et al. | B31D 5/0073 141/4 |

* cited by examiner

FLEXIBLE NOZZLE FOR INFLATION AND SEALING DEVICE

CROSS-REFERENCE TO RELATED APPLICANTS

This application claims the benefit of U.S. Provisional Application No. 61/975,648 filed on, Apr. 4, 2014 entitled "Flexible Nozzle for Inflation and Sealing Device," the content of which is hereby incorporated by reference in its entirety.

FIELD OF DISCLOSURE

The present disclosure relates to packaging materials. More particularly, the present disclosure is directed to devices and methods for manufacturing inflatable cushions to be used as packaging material.

BACKGROUND

A variety of inflated cushions are well known and used for sundry packaging applications. For example, inflated cushions are often used as void-fill packaging in a manner similar to or in place of foam peanuts, crumpled paper, and similar products. Also for example, inflated cushions are often used as protective packaging in place of molded or extruded packaging components.

Generally, inflated cushions are formed from films having two layers that are joined together by seals. The seals can be formed simultaneously with inflation, so as to capture air therein, or prior to inflation to define a film configuration having inflatable chambers. The inflatable chambers can be inflated with air or another gas or thereafter sealed to inhibit or prevent release of the air or gas.

Such film configurations can be stored in rolls or fan-folded boxes in which adjacent inflatable cushions are separated from each other by perforations. During use, a film configuration is inflated to form cushions and adjacent cushions or adjacent stands of cushions are separated from each other along the perforations.

A variety of film configurations are currently available. Many of these film configurations include seal configurations that tend to waste material, inhibit separation of adjacent inflated cushions, and/or form inflated cushions that are susceptible to under-inflation or leakage, thereby inhibiting utility.

Traditional inflation and sealing devices for filling and sealing the films to produce protective packaging material have a rigid nozzle inserted between the film layers to inflate the space between the layers. A device that provides greater robustness to variations in the film and its loading onto the device is desired.

SUMMARY

In accordance with various embodiments, a flexible structure inflation and sealing assembly may include a driver configured for engaging the flexible structure to drive the structure in a downstream direction longitudinally along a material path. The flexible structure inflation and sealing assembly may include a nozzle. The nozzle may include an elongated portion having a longitudinal axis aimed generally longitudinally and configured for reception in an inflation channel that extends through the flexible structure. The nozzle may include a fluid conduit including an outlet that directs a fluid from the conduit into the flexible structure. At least a portion of the nozzle may be sufficiently flexible to allow the longitudinal axis of the elongated portion to bend in a transverse, vertical, or combined direction to accommodate variable positions of the flexible structure being fed onto the nozzle.

In accordance with various embodiments, the nozzle may include a base having an inlet to receive an inflation fluid from a fluid source. The nozzle may include a flexible portion extending from the base and being sufficiently flexible to adapt to variation in the feed angle and direction of a flexible structure. The nozzle may include a tip region. The flexible portion may connect the base to the tip region. The flexible portion may be sufficiently flexible to allow the longitudinal axis in the tip region to move relative to the longitudinal axis defined by the base such that the longitudinal axis in the tip region and the longitudinal axis in the base can move from an aligned orientation to an unaligned orientation. The outlet may include a lateral outlet that is aimed to direct the fluid transversely with respect to the longitudinal axis. The nozzle base may include a substantially rigid tube. The base may define an inlet to receive the fluid into the conduit. The elongated portion may extend to the upstream end of the nozzle terminating at the tip region. The flexible portion may be disposed proximal to or upstream of a pinch area and the flexible structure is fed along the elongated portion to the pinch area. The nozzle base may extend upward of the pinch area. A side outlet may extend through a wall of the nozzle base. A side outlet may extend out of the flexible portion. Substantially the entire nozzle may be flexible. The flexible portion may be more flexible than the nozzle base. The flexible portion may include a spring material connecting an upstream end of the nozzle base and a downstream end of the tip region. The spring material may be a coil spring. The upstream end of the nozzle base may be closed in a longitudinal direction such that the fluid exits the nozzle before reaching the flexible portion. The tip region may be a nozzle tip, with the nozzle tip and the nozzle base being discrete structures positioned at separate ends of the flexible portion.

DETAILED DESCRIPTION OF PREFERRED EMBODIMENTS

The present disclosure is related to systems and methods for converting uninflated material into inflated cushions that may be used as cushioning or protection for packaging and shipping goods. Illustrative embodiments will now be described to provide an overall understanding of the disclosed apparatus. Those of ordinary skill in the art will understand that the disclosed apparatus can be adapted and modified to provide alternative embodiments of the apparatus for other applications, and that other additions and modifications can be made to the disclosed apparatus without departing from the scope of the present disclosure. For example, features of the illustrative embodiments can be combined, separated, interchanged, and/or rearranged to generate other embodiments. Such modifications and variations are intended to be included within the scope of the present disclosure.

Figure 1:
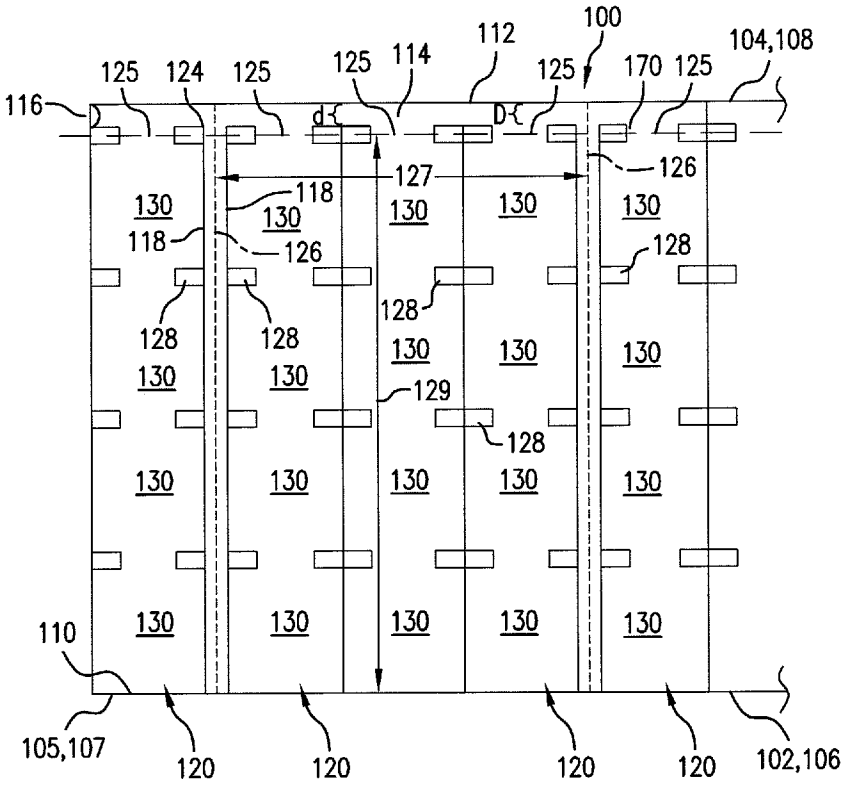
FIG. 1 is a top view of an uninflated material web according to an embodiment.

As shown in FIG. 1, a flexible structure, such as a multi-layer web 100 of film, for inflatable cushions is provided. The web includes a first film layer 105 having a first longitudinal edge 102 and a second longitudinal edge 104, and a second film layer 107 having a first longitudinal edge 106 and a second longitudinal edge 108. The second web layer 107 is aligned to be over lapping and can be generally coextensive with the first web layer 105, i.e., at least respective first longitudinal edges 102,106 are aligned with each other and/or second longitudinal edges 104,108 are aligned with each other. In some embodiments, the layers can be partially overlapping with inflatable areas in the region of overlap.

FIG. 1 illustrates a top view of the web 100 having first and second layers 105,107 joined to define a first longitudinal edge 110 and a second longitudinal edge 112 of the film 100. The first and second web layers 105,107 can be formed from a single sheet of web material, a flattened tube of web material with one edge has a slit or is open, or two sheets of web material. For example, the first and second web layers 105,107 can include a single sheet of web material that is folded to define the joined second edges 104,108 (e.g., "c-fold film"). Alternatively, for example, the first and second web layers 105,107 can include a tube of web material (e.g., a flatten tube) that is slit along the aligned first longitudinal edges 102,106. Also, for example, the first and second web layers 105,107 can include two independent sheets of web material joined, sealed, or otherwise attached together along the aligned second edges 104,108.

The web 100 can be formed from any of a variety of web materials known to those of ordinary skill in the art. Such web materials include, but are not limited to, ethylene vinyl acetates (EVAs), metallocenes, polyethylene resins such as low density polyethylene (LDPE), linear low density polyethylene (LLDPE), and high density polyethylene (HDPE), and blends thereof. Other materials and constructions can be used. The disclosed web 100 can be rolled on a hollow tube, a solid core, or folded in a fan folded box, or in another desired form for storage and shipment.

As shown in FIG. 1, the web 100 can include a series of transverse seals 118 disposed along the longitudinal extent of the web 100. Each transverse seal 118 extends from the longitudinal edge 112 towards the inflation channel 114, and in the embodiment shown, toward the first longitudinal edge 110. Each transverse seal 118 has a first end 122 proximate the second longitudinal edge 112 and a second end 124 spaced a transverse dimension d from the first longitudinal edge 110 of the film 110. A chamber 120 is defined within a boundary formed by the longitudinal seal 112 and pair of adjacent transverse seals 118.

Each transverse seal 118 embodied in FIG. 1 is substantially straight and extends substantially perpendicular to the second longitudinal edge 112. It is appreciated, however, that other arrangements of the transverse seals 118 are also possible. For example, in some embodiments, the transverse seals 118 have undulating or zigzag patterns.

The transverse seals 118 as well as the sealed longitudinal edges 110, 112 can be formed from any of a variety of techniques known to those of ordinary skill in the art. Such techniques include, but are not limited to, adhesion, friction, welding, fusion, heat sealing, laser sealing, and ultrasonic welding.

An inflation region, such as a closed passageway, which can be a longitudinal inflation channel 114, can be provided. The longitudinal inflation channel 114, as shown in FIG. 1, is disposed between the second end 124 of the transverse seals 118 and the first longitudinal edge 110 of the film. Preferably, the longitudinal inflation channel 114 extends longitudinally along the longitudinal side 110 and an inflation opening 116 is disposed on at least one end of the longitudinal inflation channel 114. The longitudinal inflation channel 114 has a transverse width D. In the preferred embodiment, the transverse width D is substantially the same distance as the transverse dimension d between the longitudinal edge 101 and second ends 124. It is appreciated, however, that in other configurations, other suitable transverse width D sizes can be used.

The second longitudinal edge 112 and transverse seals 118 cooperatively define boundaries of inflatable chambers 120. As shown in FIG. 1, each inflatable chamber 120 is in fluid communication with the longitudinal inflation channel 114 via a mouth 125 opening towards the longitudinal inflation channel 114, thus permitting inflation of the inflatable chambers 120 as further described herein.

In one preferred embodiment, the transverse seals 118 further comprise of notches 128 that extend toward the inflatable chambers 120. As shown in FIG. 1, opposing notches 128 are aligned longitudinally along adjacent pairs of transverse seals 118 to define a plurality of chamber portions 130 within the inflatable chambers 120. The notches 118 create bendable lines that allow for a more flexible web 100 that can be easily bent or folded. Such flexibility allows for the film 100 to wrap around regular and irregular shaped objects. The chamber portions 130 are in fluid communication with adjacent chamber portions 130 as well as with the inflation channel 114.

A series of lines of weaknesses 126 is disposed along the longitudinal extent of the film and extends transversely across the first and second web layers of the film 100. Each transverse line of weakness 126 extends from the second longitudinal edge 112 and towards the first longitudinal edge 110. Each transverse line of weakness 126 in the web 100 is disposed between a pair of adjacent chambers 120. Preferably, each line of weakness 126 is disposed between two adjacent transverse seals 118 and between two adjacent chambers 120, as depicted in FIG. 1. The transverse lines of weakness 126 facilitate separation of adjacent inflatable cushions 120.

The transverse lines of weakness 126 can include a variety of lines of weakness known by those of ordinary skill in the art. For example, in some embodiments, the transverse lines of weakness 126 include rows of perforations, in which a row of perforations includes alternating lands and slits spaced along the transverse extent of the row. The lands and slits can occur at regular or irregular intervals along the transverse extent of the row. Alternatively, for example, in some embodiments, the transverse lines of weakness 126 include score lines or the like formed in the web material.

The transverse lines of weakness 126 can be formed from a variety of techniques known to those of ordinary skill in the art. Such techniques include, but are not limited to, cutting (e.g., techniques that use a cutting or toothed element, such as a bar, blade, block, roller, wheel, or the like) and/or scoring (e.g., techniques that reduce the strength or thickness of material in the first and second web layers, such as electromagnetic (e.g., laser) scoring and mechanical scoring).

Preferably, the transverse width 129 of the inflatable chamber 120 is 3" up to about 40", more preferably about 6" up to about 30" wide, and most preferably about 12". The longitudinal length 127 between weakened areas 126 can be at least about 2" up to about 30", more preferably at least about 5" up to about 20", and most preferably at least about 6" up to about 10". In addition, the inflated heights of each inflated chamber 120 can be at least about 1" up to about 3", and most preferably about 6". It is appreciated that other suitable dimensions can be used.

Figure 2:
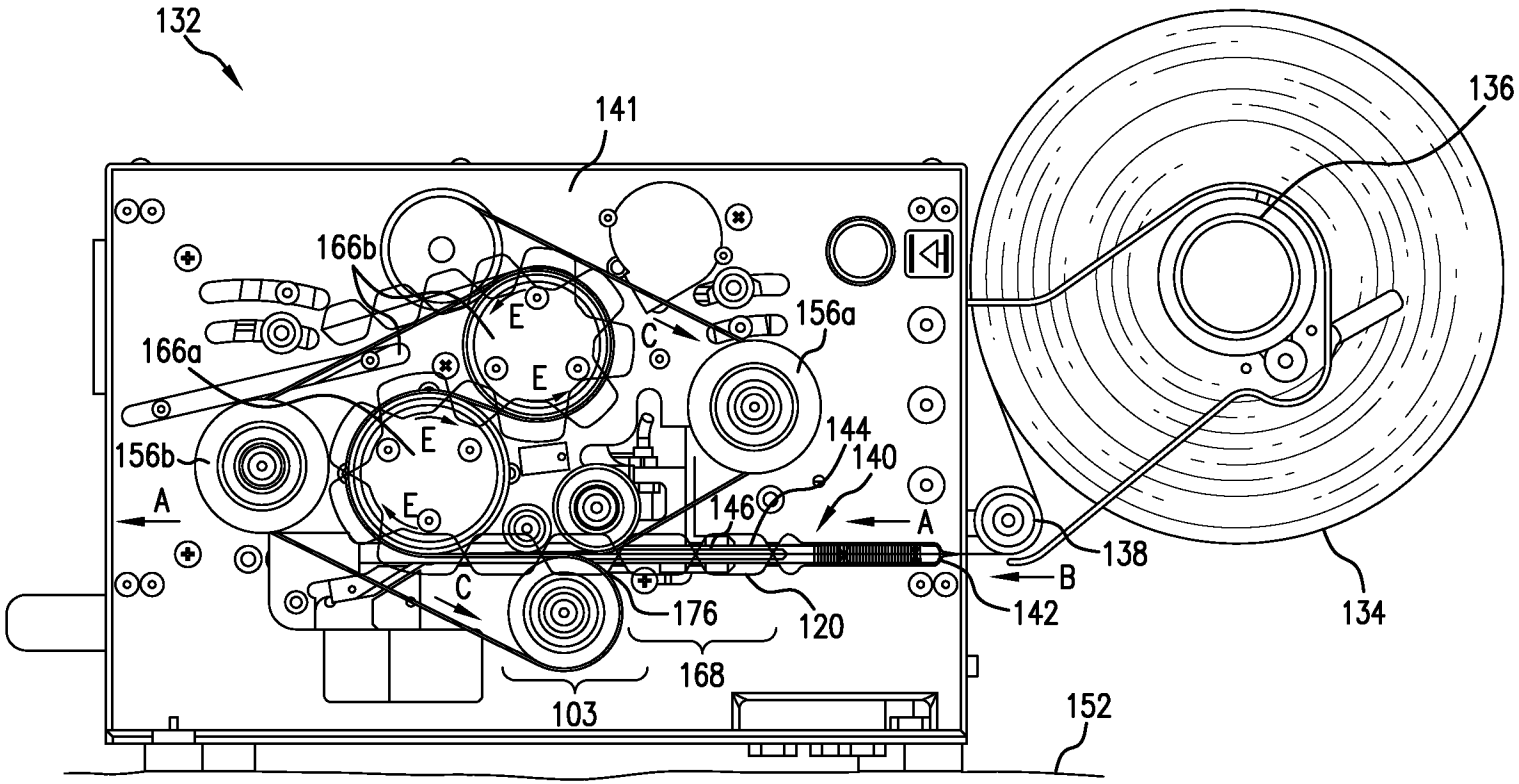
FIG. 2 is side view of the inflation and sealing assembly in accordance with various embodiments.

Turning now to FIG. 2, an inflation and sealing assembly 132 for converting the web 100 of uninflated material into a series of inflated pillows or cushions 120 is provided. As shown in FIG. 2, the uninflated web 100 can be a roll of material 134 provided on a roll axle 136. The roll axle 136 accommodates the center of the roll of web material 134. Alternative structures can be used to support the roll, such as a tray, fixed spindle or multiple rollers.

The web 100 is pulled by a drive mechanism over an optional guide roller 138 that extending generally perpendicularly from a housing 141. The guide roller 138 guides the web 100 away from the roll of material 134 and along a material path "B" along which the material is processed in a longitudinal direction "A". In one example, the guide roller 138 may be a dancer roller which may aid in controlling the material 134, such as keeping it from sagging between an inflation nozzle 140 and roll 134. To prevent or inhibit bunching up of the web material 100 as it is unwound from the roll 134, the roll axle 136 can be provided with a brake to prevent or inhibit free unwinding of the roll 134 and to assure that the roll 134 is unwound at a steady and controlled rate. However, as discussed herein, other structures may be utilized in addition to or as an alternative to use of brakes, guide rollers, or web feed mechanisms in order to guide the web 100 toward the pinch area 176 which is part of the sealing mechanism. As indicated, because the web 100 may sag, bunch up, drift along the guide roller 138, shift out of alignment with the pinch zone 176, alternate between tense and slack, or become subject to other variations in delivery, the inflation and sealing assembly 132 may need suitable adjustability to compensate for these variations. In accordance with various embodiments discussed herein, a nozzle 140 may be at least partially flexible. This flexibility, may allow the nozzle 140 to adapt to the direction the web 100 approaches as the web is fed towards and over the nozzle 140, thereby making the nozzle 140 operable to compensate for or adapt too variations in the feed angle, direction, and other variations that the web 100 encounters as it is fed towards and over the nozzle 140.

Preferably, the inflation and sealing assembly is configured for continuous inflation of the web 100 as it is unraveled from the roll 134. The roll 134, preferably, comprises a plurality of chain of chambers 120 that are arranged in series. To begin manufacturing the inflated pillows from the web material 100, the inflation opening 116 of the web 100 is inserted around an inflation assembly, such as an inflation nozzle 140, and is advanced along the material path "E". In the embodiment shown in FIG. 2, preferably, the web 100 is advanced over the inflation nozzle 140 with the chambers 120 extending transversely with respect to the inflation nozzle 140 and side outlets 146. The side outlets 146 may direct fluid in a transverse direction with respect to a nozzle base 144 into the chambers 120 to inflate the chambers 120 as the web 100 advanced along the material path "E" in a longitudinal direction "A". The inflated web 100 is then sealed by the sealing assembly 103 in the sealing area 174 to form a chain of inflated pillows or cushions.

The side inflation area 168 is shown as the portion of the inflation and sealing assembly along the path "E" adjacent the side outlets 146 in which air from the side outlets 146 can inflate the chambers 120. In some embodiments, the inflation area 168 is the area disposed between the inflation tip 142 and entry pinch area 176, described below. The web 100 is inserted around the inflation nozzle 140 at the nozzle tip 142, which is disposed at the forward most end of the inflation nozzle 140. The inflation nozzle 140 inserts a fluid, such as pressured air, into the uninflated web material through nozzle outlets, inflating the material into inflated pillows or cushions 120. The inflation nozzle 140 can include a nozzle inflation channel 143 there through that fluidly connects a fluid source, which enters at a fluid inlet 143*a*, with one or more nozzle outlets (e.g. side outlet 146). It is appreciated that in other configurations, the fluid can be other suitable pressured gas, foam, or liquid. The nozzle may have an elongated portion which may include one or more of a nozzle base 144, a flexible portion, and a tip. The elongated portion may guide the flexible structure to a pinch area 176. At the same time the nozzle may inflate the flexible structure through one or more outlets. The one or more outlets may pass from the inflation channel 143 out of one or more of the nozzle base 144 (e.g. outlet 146), the flexible portion (e.g. outlet 146*b* of core 147 shown in FIG. 3G), or the tip 142 (e.g. outlet 148).

Figure 2A:
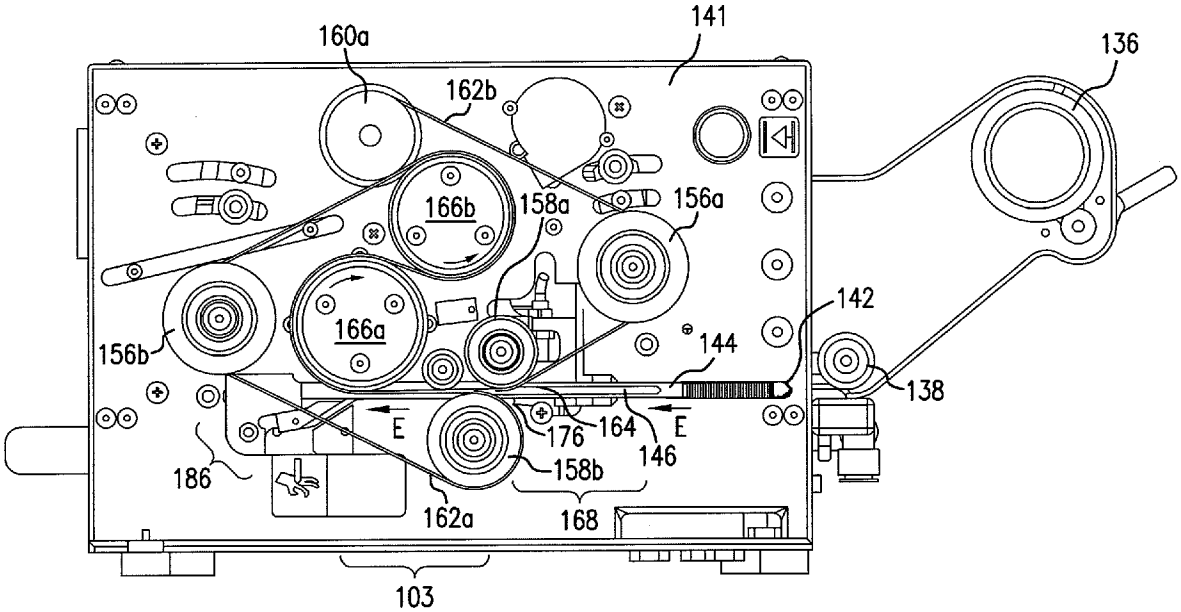
FIG. 2A is side view of the inflation and sealing assembly in accordance with various embodiments.
Figure 3A:
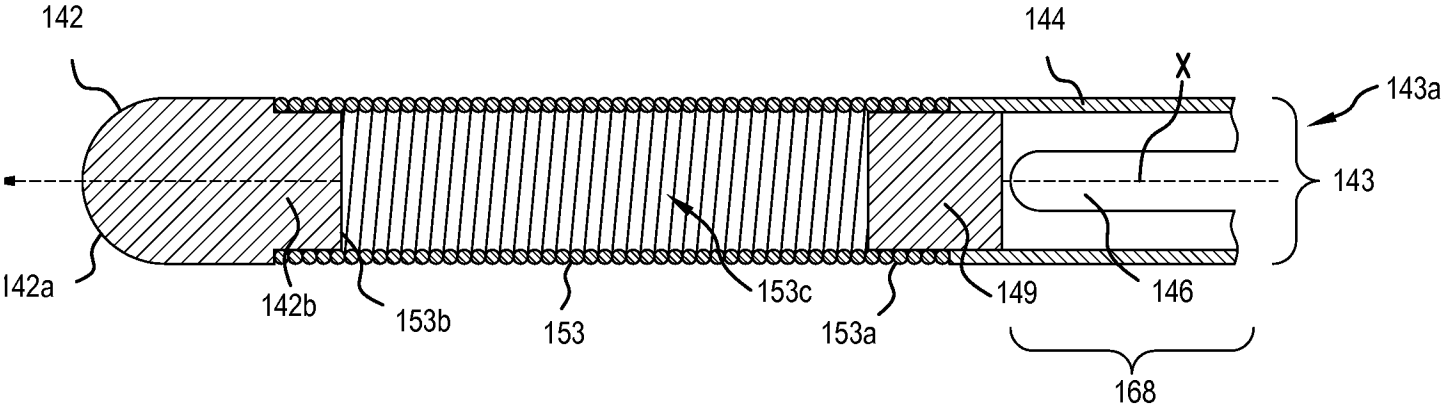
FIGS. 3A-C are partial cross-sectional views of inflation nozzles in accordance with various embodiments.
Figure 3B:
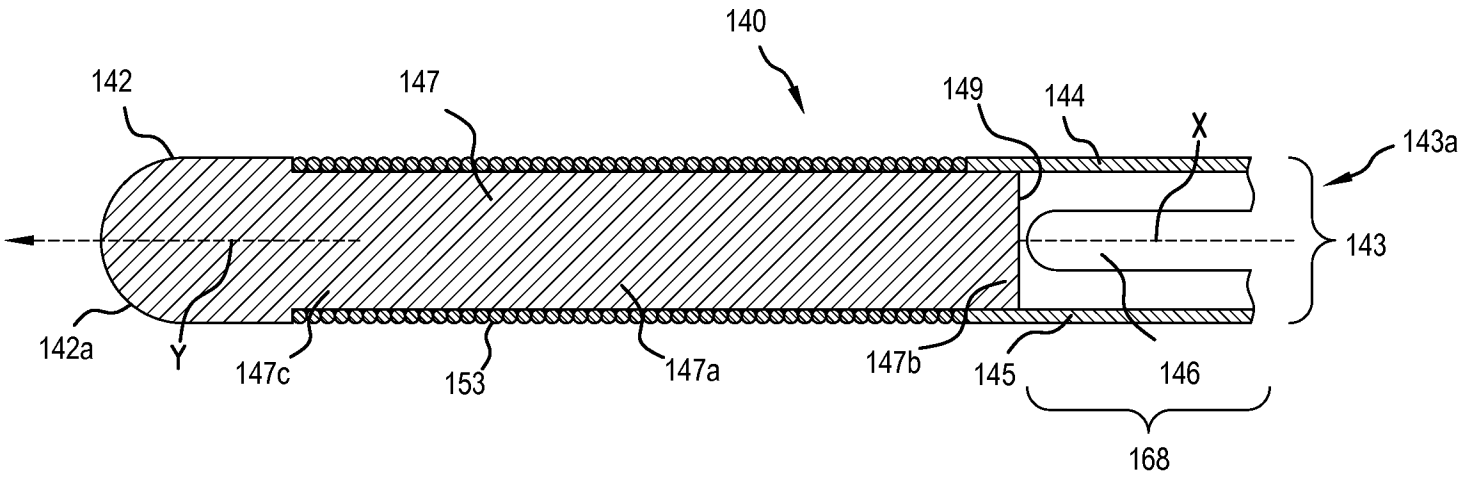
Figure 3C:
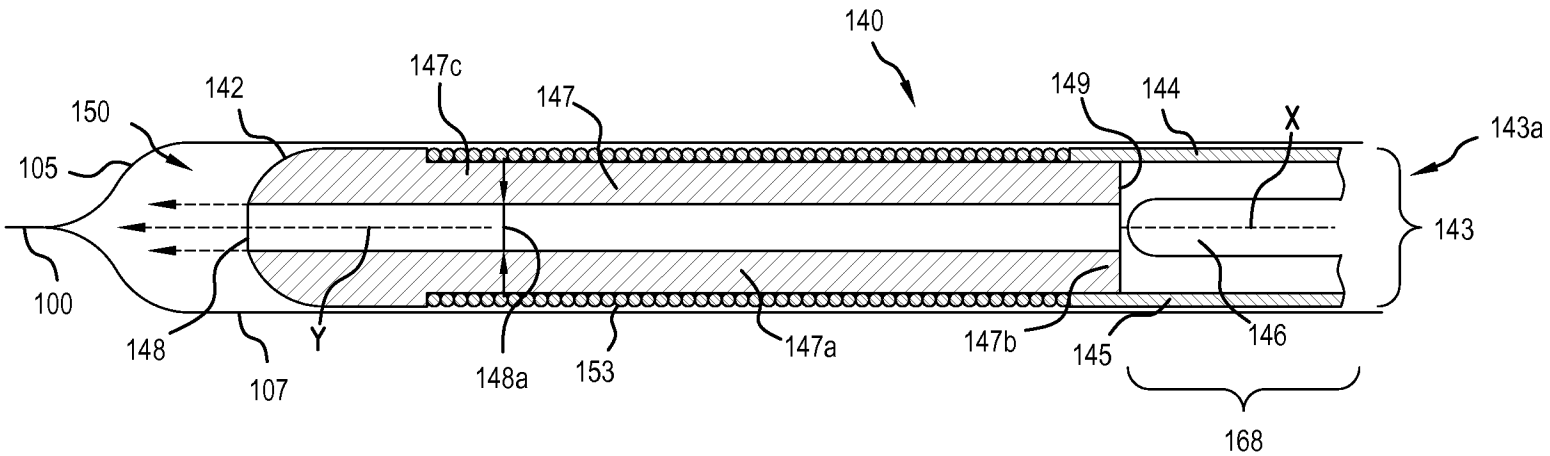

FIGS. 3A-C illustrate enlarged views of a portion of various embodiments of nozzle 140. As shown in FIG. 3A-C, the side outlet 146 can extend longitudinally along the nozzle base 144 toward a longitudinal distance from the inflation tip 142. In the one embodiment, the side outlet 146 originates proximate, or in some configurations, overlapping, the sealer assembly such that the side outlet 146 continues to inflate the inflatable chambers 120 about right up to the time of sealing (see, e.g., FIG. 2 or 2A). This can maximize the amount of fluid inserted into the inflatable chambers 120 before sealing, and minimizes the amount of dead chambers, i.e., chambers that do not have sufficient amount of air. Although, in other embodiments, the slot outlet 146 can extend downstream past the entry pinch area 176 (see, e.g., FIG. 2A), and portions of the fluid exerted out of the outlet 146 is directed into the web 100. As used herein, the terms upstream and downstream are used relative to the direction of travel of the web 100. The beginning point of the web is upstream and it flows downstream as it is inflated, sealed, cooled and removed from the inflation and sealing device.

The length of the side outlet 146 may be a slot having a length that extends a portion of the inflation nozzle 140 between the tip 142 and the entry pinch area 176. In one example, the slot length may be less than half the distance from the tip 142 to the entry pinch area 176. In another example, the slot length may be greater than half the distance from the tip 142 to the entry pinch area 175. In another example, the slot length may be about half of the distance from the tip 142 to the entry pinch area 175. The side outlet 146 can have a length that is at least about 30% of the length of the inflation nozzle 140, for example, and in some embodiments at least about 50% of the length of the inflation nozzle 140, or about 80% of the length 169 of the inflation nozzle 140, although other relative sizes can be used. The side outlet 146 expels fluid out the lateral side of the nozzle base 144 in a transverse direction with respect to the inflation nozzle 140 through the mouth 125 of each of the chambers 120 to inflate the chambers 120 and chamber portions 130. A portion of the side of the nozzle may be closed behind the tip 142, such as about 10%, 20%, 30%, 40%, 50% or more of the nozzle.

The flow rate is typically about 2 to 15 cfm, with an exemplary embodiment of about 3 to 5 or cfm. The exemplary embodiment is with a blower rated at approximately 14-20 cfm. But much higher blow rates can be used, for example, when a higher flow rate fluid source is used, such as, a blower with a flow rate 1100 cfm.

In some configurations of the side outlet 146, the side outlet 146 comprises a plurality of outlets, such as slots or separate holes, which extend along the nozzle base 144. For example, the side outlet 146 can include a plurality of slots that are aligned in a series extending along the longitudinal side of the nozzle base 144 toward the inflation tip 142, which slots can be aligned parallel to each other, or in various radial directions about the axis of the nozzle base.

The nozzle 140 may further include a portion with a fixed longitudinal axis X and a portion with a movable longitudinal axis Y. The nozzle 140 may further include a flexible joint which allows axis Y to be adjustable relative to axis X such that axis Y can be substantially coaxial with axis X and also be movable such that axis X and axis Y are not coaxial but may be, for example, intersecting, parallel, or skew relative to one another.

FIG. 3A illustrates the nozzle 140 in accordance with various embodiments. The nozzle 140 may include nozzle base 144 which is defined by an exterior wall 145. The exterior wall 145 defines a fluid conduit 143. The fluid conduit 143 may have an inlet 143*a* (see also FIGS. 3D-3F). The exterior wall 145 may be a cylindrical tube. The exterior wall 145 may also be any other shape operable to transport a fluid there through. The side outlet 146 may extend through the exterior wall 145. The nozzle 140 may also include tip 142. Tip 142 may have a tapered surface 142*a*. The tip may be metallic, plastic, or rubber. The tip may be a tip region able to receive and insert into an inflation channel on a flexible structure. In embodiments where the tip 142 is cylindrical, frustum or any other shape defining an axis, the axis Y may be coaxial with the axis of the cylinder defining tip 124.

In various embodiments, the nozzle 140 may include axis X which may be located axially along the fluid conduit 143 longitudinally. In this orientation, the axis X may be aligned with the fluid travel through the fluid conduit 143. The nozzle 140 may also include an axis Y, which may be located longitudinally along the longitudinal length of nozzle 140 such as, for example, at the tip 142. The axis X and the axis Y may also or alternatively be any separate discrete portions along the longitudinal length of the nozzle 140 which may define the longitudinal direction of the nozzle 140 at those respective points. The nozzle 140 may be sufficiently flexible such that axis X and the axis Y may be aligned in one instance or out of alignment in another instant in response to a force being applied to the nozzle 140. In one embodiment, the entire length of the nozzle may be flexible. In another embodiment, discrete sections of the nozzle 140 may be flexible. For example, the flexible area may be upstream or downstream of the inflation outlet (e.g. outlet 146). In various examples, one portion may be substantially rigid while another portion may be more flexible than the substantially rigid portion. The pinch area 176 may be proximate to the transition 144*b* in the nozzle between rigid and flexible, i.e. the flexible portion may start at or upstream of the pinch area 176 as shown in FIG. 3G. For example, the nozzle may be flexible upstream of the pinch area and rigid downstream of the pinch area. In another example, the nozzle may be both flexible and rigid upstream of the pinch area. The rigid portion of the nozzle (e.g. the nozzle base 144) may be 1½ to 2 times the length of the flexible portion of the nozzle (e.g. core 147 and/or member 153 discussed below).

In accordance with various embodiments and shown in FIG. 3A, tip 142 and nozzle base 144 may be connected by one or more flexible connectors. In one embodiment, the flexible connector may include a flexible member 153. The flexible member 153 may extend from the nozzle base 144 to the tip 142. The flexible member 153 may be a separate structure and/or material than either of the nozzle base 144 or the tip 142. In one example, the flexible member 153 may be a coiled wire such as a spring which extends from the nozzle base 144 to the tip 142. The flexible member 153 may be sufficiently flexible such that it can bend or deform in order to improve alignment between the tip 142 and the inflation opening 116 as the flexible structure 100 approaches and is fed over the nozzle. The flexible member 153 may also be sufficiently rigid such that the flexible member 153 maintains its general shape and direction, extending the tip 142 away from nozzle base 144 in the direction from which the flexible structure 100 approaches. As the flexible structure 100 approaches and the inflation opening 116 engages the tip 142, the flexible member 153 may deflect and adapt to the orientation of the inflation opening 116 such that the inflation channel 114 slides more easily over the nozzle 140. Similarly, if during operation the flexible structure 100 drifts out of alignment, the flexible member 153 may deflect and adapt to the orientation of the inflation channel 114. It may be noted that as shown in the figures the inflation channel 114 is on one edge of the web 100, however the channel may be on both edges or down the center of the web 100 on various other devices and setups. The system as disclosed herein is applicable to all types of and location of inflation channels such as those down the center of web 100 with cushions extending from both sides.

The flexible member 153 may attach to a nozzle base end 149 that terminates on the upstream end of the nozzle base 144. The nozzle base end 149 may be a contiguous portion having the same material as the rest of nozzle base 144. Alternatively, the nozzle base end 149 may be a separate material that caps the end of the nozzle base 144. For example the nozzle base end 149 may be a flexible elastomeric material or a harder polymer or any other material known to a person of ordinary skill in the art. The nozzle base end 149 may prevent air from exiting the nozzle longitudinally. In other embodiments discussed below, nozzle base end 149 may form the entrance to a passage that extends through a flexible core 147 (see FIG. 3C). The nozzle base end 149 may also function as a structure to which the flexible member 153 may attach. For example, the nozzle base end 149 may be a vertical wall at the end of fluid conduit 143. As shown in FIG. 3A, the nozzle base end 149 may be a plug that engages within the fluid conduit 143 and also within an interior channel of the spring like flexible member 153 at the downstream end 153*a* of the flexible member, thereby connecting the two. The tip 142 may similarly be fastened to the end of the flexible member 153. Alternatively or additionally, the downstream end 142*b* of tip 142 may be inserted into the upstream end 153*b* of interior channel 153*c* as shown for example in FIG. 3A. In various embodiments, the nozzle base end 149 and the tip 142 may be two discrete structures separated from one another by the flexible member 153. In one embodiment, the flexible member may be formed of a contiguous material with the nozzle base 144 and or nozzle tip 142. The flexible member 153 may be larger in diameter or smaller in diameter than adjacent portions of the nozzle. As shown the flexible member 153 may be a similar size to the adjacent nozzle portions.

FIG. 3B illustrates the nozzle 140 in accordance with another embodiment. Here as above, the nozzle 140 may include nozzle base 144 as defined by exterior wall 145. The exterior wall 145 defines a fluid conduit 143 which may be cylindrical tube or any other shape operable to transport a fluid there through as discussed above. The side outlet 146 may be similar to the various other embodiments discussed herein. Similarly, the nozzle 140 may include the tip 142 with the axis X and axis Y being located in the same manner as discussed above. Tip 142 and nozzle base 144 may be connected by one or more flexible connectors. In accordance with this embodiment, the one or more flexible connectors may include a flexible core 147. The flexible core 147 may have one or more of an intermediate core 147*a*, first end 147*b*, and a second end 147*c*. In various examples, the second end of 147*c* of the flexible core 147 may be a contiguous part of tip 142. Alternatively, the flexible core 147 may be a discrete part in which 142 attaches to the second end of 147*c* of the flexible core 147 via a fastener or the like. The flexible core 147 may be sufficiently flexible such that it can bend or deform in order to improve alignment between the tip 142 and the inflation opening 116 as the flexible structure 100 approaches and is fed over the nozzle 140. The flexible core 147 may also be sufficiently rigid such that the flexible core 147 maintains its general shape and direction, extending to the tip 142 away from nozzle base 144 in the direction from which the flexible structure 100 approaches. In one example, the flexible core 147 may be a flexible elastomeric material. In other examples the rigidity or flexibility may be increased by utilizing various compositions or other materials.

As the flexible structure 100 approaches and the inflation opening 116 engages the tip 142, the flexible core 147 may deflect and adapt to the orientation of the inflation opening 116 such that the inflation channel 114 slides more easily over the nozzle 140. Similarly, if during operation the flexible structure 100 drifts out of alignment, the flexible core 147 may deflect and adapt to the orientation of the inflation channel 114.

In one embodiment, the nozzle base 144 may be connected to tip 142 by only the flexible core 147 or, as discussed above, the nozzle base 144 may be connected to tip 142 by only the flexible member 153. In another embodiment, the nozzle base 144 may be connected to tip 142 by more than one flexible element. For example, the flexible member 153 may be added to the exterior of flexible core 147. The flexible core 147 may be positioned coaxially to the flexible member 153. While both the flexible core 147 and the flexible member 153 may be flexible, they may have differing functions. For example, the flexible member 153 may have a metal surface or a surface of another suitable material that facilitates transition of the inflation channel 114 by reducing friction. Whereas the flexible core 147 may provide longitudinal support to the flexible member 153. Alternatively or additionally, as illustrated in FIG. 3C, the flexible core may provide a channel through one or more of the flexible elements allowing the nozzle 140 to include a longitudinal outlet, such as a nozzle tip outlet 148. Specifically, the inflation tip 142 may include a nozzle tip outlet 148 that is fluidly connected to the fluid conduit 143 within the nozzle base 144 to expel fluid upstream out of the nozzle tip outlet 148. The nozzle base 144 may have a longitudinal axis extending along and defining the material path "E," and the tip outlet 148 may be aimed from the nozzle base 144 and flexible element in the direction that the flexible structure 100 approaches the nozzle 140, which may be generally an upstream direction B along the longitudinal axis. In this embodiment, the nozzle base 144 defines the material path "E" laterally adjacent thereto.

In inflation nozzles not including a tip outlet 148, the tip of the inflation nozzle can be used to pry open and separate the web layers in an inflation channel at the tip as the material is forced over the tip. For example, when the web is pulled over traditional inflation nozzles, the tip of the traditional inflation nozzles forces the web layers to separate from each other. In some embodiments, the majority of the fluid from the fluid source is expelled from the side outlet 146, but a portion of the fluid may be expelled from the nozzle tip outlet 148 to improve the material flow of the web 100 over the nozzle. The portion of the fluid being expelled from the nozzle tip outlet 148 creates a pressurized flow, producing a pressurized column of the fluid upstream of the nozzle 140 that can act as a guide that pre-aligns the web 100 with the nozzle 140 and separates the layers upstream of and before they reach the nozzle tip 142. As the layers arrive at the tip separated, they do not need to be pried or wedged apart by the tip 142, which reduces noise and vibration caused in traditional inflation nozzles.

This longitudinal outlet may be in addition to or in the absence of a lateral outlet, such as side outlet 146, which may be downstream of the tip outlet 148 and along the longitudinal side of the nozzle wall of the nozzle base 144 of the inflation nozzle 140. The nozzle tip outlet 148 may be at the upstream-most tip 142 of the nozzle 140 with respect to the material flow direction along the path A, at the distal end of the inflation nozzle 140. The side outlet 148 may be the principal outlet that provides the primary fluid source for inflating the chambers 120, and the nozzle tip outlet 148 operates to stabilize the advancing web 100 as it approaches the inflation nozzle 140. It is appreciated that the fluid expelled from the nozzle tip outlet 148 can also help inflate the chambers 120.

FIG. 3C depicts a side view of the nozzle 140 expelling fluid 151 from the nozzle tip outlet 148 into the inflation channel 116 of the web 100. As illustrated in FIG. 3C, the fluid 151 being expelled from the nozzle tip outlet 148 forms the expanded, fluid-pressurized column 150 that separates the first web layer 105 and second web layer 107 and also acts as a guide to guide the web 100 over the inflation nozzle 140. This facilitates the inflation channel 114 of the web 100 to easily slide over the inflation nozzle 140, which allows for faster inflation of the web 100 because the web 100 can be pulled over inflation nozzle 140 quicker with less resistance. Further, expelling fluid out of the tip outlet 148 increases the life of the nozzle tip 142. While the tip outlet 148 is sufficiently aligned with the nozzle axis to achieve the above effects. The diameter 148*a* of the tip outlet 142 and amount of fluid expelled from the tip outlet 142 may be sufficient to expel a pressurized flow sufficient to push and separate the first and second web layers 105,107 from each other to facilitate sliding the web over the inflation nozzle 140.

The tapered end of the inflation tip 142 facilitates the easy sliding of the inflation channel 114 over the inflation nozzle 140 in addition to the fluid 150 being expelled from the tip outlet 148. The inflation tip 142 may have the nozzle tip outlet 148 in some embodiments and may not have the nozzle tip outlet 148 in other embodiments. In one example, the tip 142 may be a contiguous portion of the flexible core 147 as shown in FIG. 3B without the nozzle tip outlet 148. In one example, the tip 142 may be a contiguous portion of the flexible core 147 as shown in FIG. 3C with the nozzle tip outlet 148. In one example, the tip 142 may be a discrete portion of the nozzle 140 not attached to a flexible core as shown in FIG. 3A and used without the nozzle tip outlet 148. While FIG. 3A shows the nozzle base end 149 as being relatively short compared to the length of the flexible member 153, the nozzle base end 149 may be any length. For example the nozzle base end 149 may be long enough to contact the discrete tip 142 and provide support to the flexible member 153 similar to the example shown in FIG. 3B.

Figure 3D:
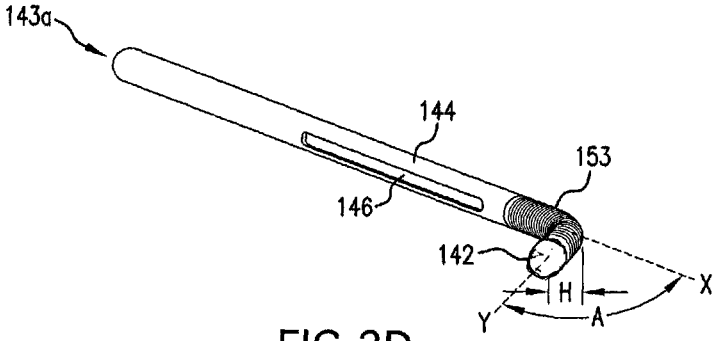
FIGS. 3D-F are a perspective views of the inflation nozzle being flexed in accordance with various embodiments.
Figure 3E:
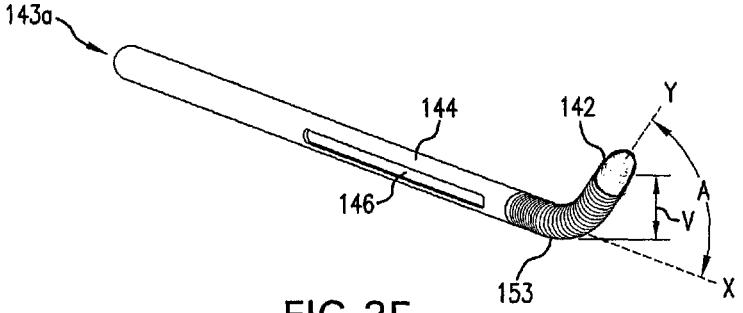
Figure 3F:
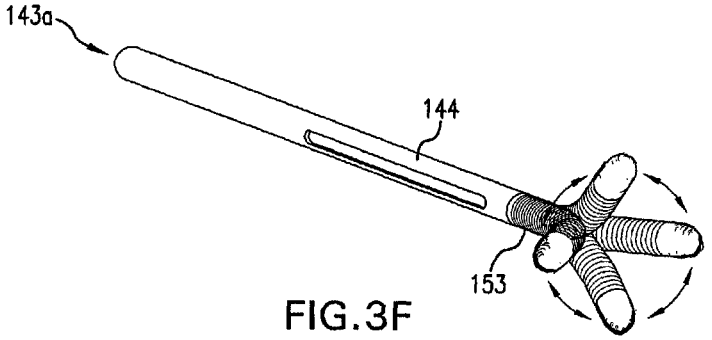
Figure 3G:
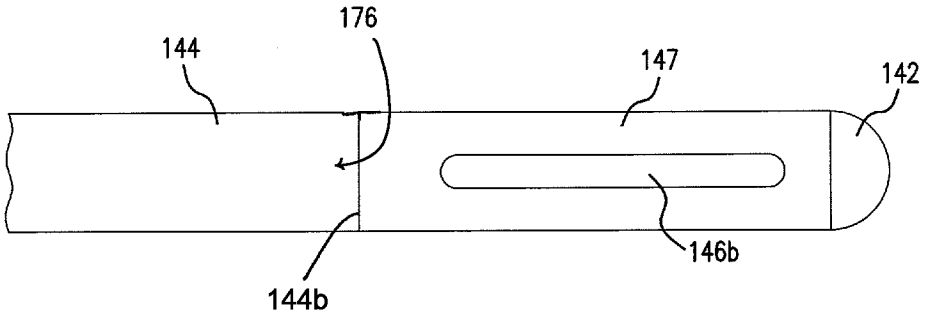
FIG. 3G is a side view of an inflation nozzle in accordance with various embodiments.

FIG. 3D illustrates one embodiment of the inflation nozzle. The inflation tip 142 can have a conical shape with a tapered end extending upstream the assembly. The tip 142 and upstream end portion of the nozzle may be displaced out of alignment with the inflation nozzle base 144. As shown in FIG. 3D, this deflection may be measured transversely (relative to the feed direction) as depicted by distance H. This may be in the same direction or plane as the outlet 146. Additionally or alternatively, as shown in FIG. 3E, the deflection may be measured vertically as depicted by distance V. This vertical direction may be measured perpendicular to the feed direction and/or perpendicular to the transvers direction of the material. As shown in FIG. 3F, this deflection may be a combination of lateral deflection and vertical deflection giving the tip a full range of motion as depicted by the various tips and arrows shown in FIG. 3F. In one example, the end of the nozzle may deflect such that it forms an angle A of less than about 90° and more than 0° along the longitudinal axis (e.g. axis X and Y discussed above form an acute angle) as viewed from the upstream end of the nozzle 140 (see FIGS. 3D and 3E). In one example, the end of the nozzle may deflect such that it forms an angle A of less than about 60° and more than 0° along the longitudinal axis (e.g. axis X and Y discussed above form a about 55° angle) as viewed from the upstream end of the nozzle 140 (see FIGS. 3D and 3E). In one example, the end of the nozzle 140 may deflect such that it forms an angle A between about 5° and about 45° along the longitudinal axis (i.e. axis X and Y discussed above form an angle between about 5°-45°) as viewed from the upstream end of the nozzle 140 (see FIGS. 3D and 3E). In various embodiments, the flexibility of the nozzle 140 may be such that a force of 1 pound on the tip 142 is sufficient to fully deflect the nozzle. The Nozzle 140 may be sufficiently flexible to bend in response to misaligned inflation channel on the flexible structure but be sufficiently ridged to direct the inflation channel of the flexible structure toward the pinch area 176.

Figure 4A:
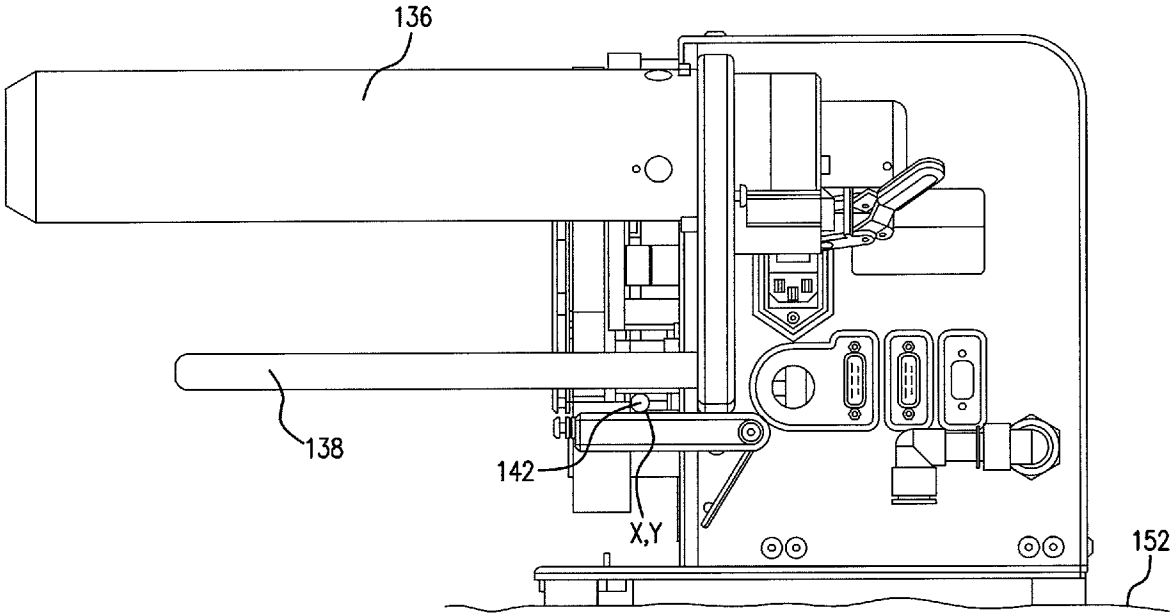
FIG. 4A is a rear view of the inflation and sealing assembly of FIG. 2 with a longitudinally aligned inflation nozzle.
Figure 4B:
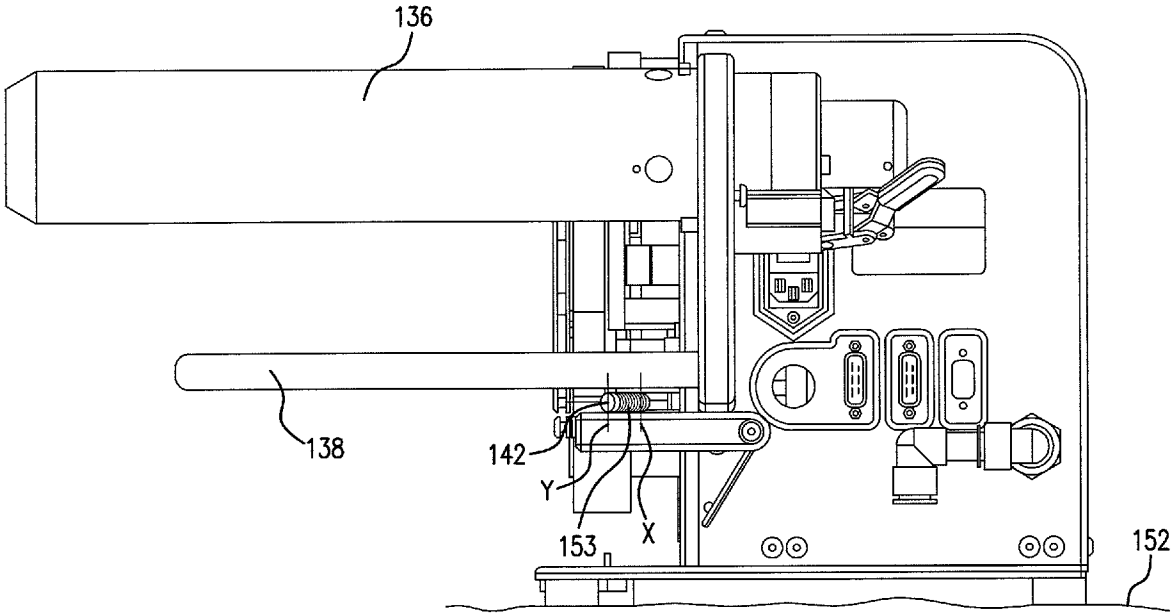
FIG. 4B is a rear view of the inflation and sealing assembly of FIG. 2 with a flexed inflation nozzle.

In various embodiments, the inflation nozzle 140 is positioned horizontally with respected to the horizontal plane 152 as shown in FIGS. 2 and 4A-B. In other embodiments the inflation nozzle 140 may be angled such that it aligns material path "E" of the sealing assembly to approach the nozzle 140 in a downward, slanted angle. The angle can also be such that the path approaches in an upward direction. In various examples, the angle of the nozzle 140 relative to the horizontal plane 152 may be about 5° or 10° upwards from the horizontal in an upstream direction, or to up to about 30°, 45°, or 60° with respect to the horizontal plane 152. The inflation nozzle base 144 and its longitudinal axis X may be aligned tangentially to the sealing drum. As indicated elsewhere, the nozzle 140 may be flexible. So while it may have a general longitudinal orientation and angle relative to the base plane, that general orientation may be movable due to flexibility of the nozzle.

Figure 5B:
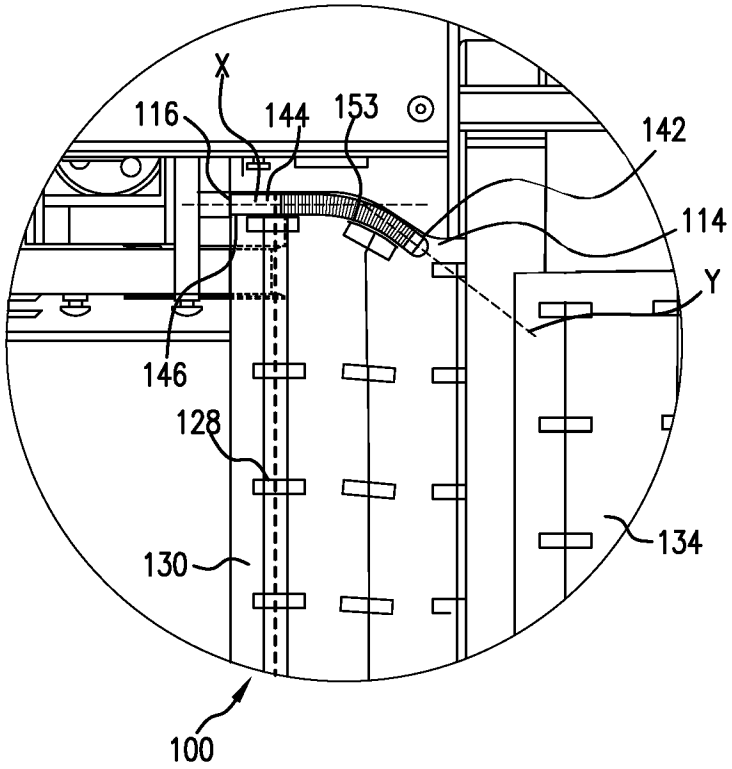
FIG. 5B is a top partial view of the inflation and sealing assembly of FIG. 2 with a flexed inflation nozzle.
Figure 5A:
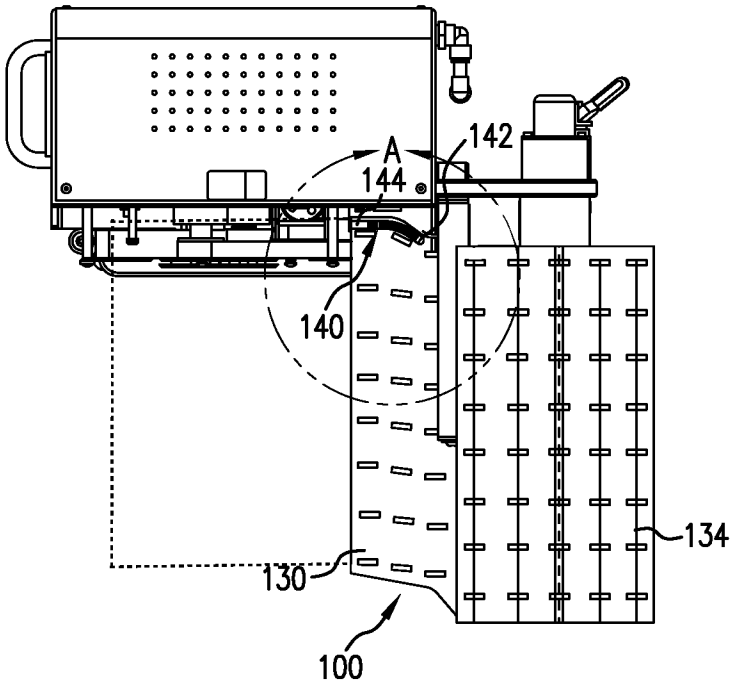
FIG. 5A is a top view of the inflation and sealing assembly of FIG. 2 with a flexed inflation nozzle.

FIGS. 4A and 4B show rear views of the inflation and sealing assembly. As shown in FIG. 4A the axes X, Y of the nozzle base 144 and the nozzle tip 142, respectively, are aligned. As is typical in traditional inflation and sealing devices, the web 100 may have to be aligned with a rigid nozzle. This alignment may take physical manipulation of the web or even if the opening 116 of the longitudinal channel 114 where aligned from the start, continued operation of the inflation and sealing assembly device may result in a tendency for the longitudinal channel 114 to drift out of alignment. This may substantially increase the forces against the nozzle 140 to maintain alignment. Increased forces may result in drag on the web 100 and potential failure of the inflation and sealing assembly device. As shown in FIG. 4B the axes X, of the nozzle base 144 and the nozzle tip 142, respectively, are not in alignment. When out of alignment from this view, the flexible connector is also shown. By providing a flexible portion between tip 142 and base 144, their relative axes are able to misalign. This misalignment may ease the insertion of the nozzle 140 into the opening 116 of the web 100 and or the misalignment may reduce forces between the web 100 and the nozzle 140 in response to the web 100 drifting out of alignment, thereby improving operation of the inflation and sealing assembly device. FIGS. 5A and 5B further illustrate the operability of the nozzle 140 to misalign with the web 100. As shown, a roll 134 or web 100 is mounted on the inflation and sealing assembly 132. Nozzle 140 is engaged within the inflation channel 114. Notably shown in the FIGS. 5A and 5B is that the inflation channel 114 is not linear. Instead, the inflation channel has engaged tip 142, bent around the flexible member 153, and then continued over the nozzle base 144. The axis X of the nozzle base 144 and the axis Y of the tip 142 are not aligned but are instead misaligned providing for a gradual transition of the inflation channel 114 around the nozzle from a misaligned state to an aligned state on the nozzle base 144.

FIG. 2A illustrates a side view of the preferred inflation and sealing assembly 101. As shown, the fluid source can be disposed behind a housing plate 184 or other structural support for the nozzle and sealing assemblies, and preferably behind the inflation nozzle 140. The fluid source is connected to and feeds the fluid inflation nozzle conduit 143. The web 100 is fed over the inflation nozzle 140, which directs the web to the inflation and sealing assembly 101. The web 100 is advanced or driven through the inflation and sealing assembly by a drive mechanism, such as by a driver or sealing drum 166*a* or the drive roller 160, in a downstream direction along a material path "E". In accordance with various embodiments, any of the rollers or drums may drive the system.

When viewed from the top, in FIG. 2A, facing one of the principal surfaces of the upper film layer, in a transverse direction extending between the drum 17 and the belt 162, the sealing assembly 103 is positioned transversely between the nozzle and the chambers being inflated to seal across each of the transverse seals. Some embodiment can have a central inflation channel, in which case a second sealing assembly and inflation outlet may be provided on the opposite side of the nozzle. Other known placement of the web and lateral positioning of the inflation nozzle and sealing assembly can be used.

Preferably, the sealing assembly is attached to the housing plate 184. The sealing assembly 103 includes one or more traction members, such as belts 162*a* and 162*b*, which are wrapped along rotating members, such as rollers. Belt 162*a,b* may be wrapped around tension rollers 156*a,b*, roller 158*a,b*, and rollers 160*a,b*, (any of which may be the drive roller) although in other embodiments, a plurality of belts or a single belt can be used. After inflation, the web 100 is advanced along the material path "E" towards a web feed area 164 where it enters the sealing assembly 103. The web feed area 164 may disposed between the belts 162 *a,b* although in other embodiments of machines with a single belt the area may be between a pinch roller and drum 166*a*. The web feed area 164 can include an entry pinch area 176. The entry pinch area 176 is the region in which the first and second web layers 105,107 are pressed together or pinched to prevent fluid from escaping the chambers 120 and to facilitate sealing by the sealing assembly 103. The pinch area 176 may be the area where belts 162 *a,b* are in contact or the pinch area may be between the sealing drum and the portion of the belt downstream of the pinch roller. The belts 162*a,b* or other pinch area components may have sufficient tension to tightly pinch or press the web layers 105,107 together against the drum 17.

The belts 162*a,b* may be driven in a drive path or direction shown by arrow "C" in FIG. 2A by the rollers. The drive rollers 160*a,b* may associated or connected with a drive mechanism that rotates the drive rollers 160*a,b* to move the belt 162 along the drive path "C" and advance the web 100. Preferably, the drive mechanism is connected to a motor located within the housing 141. The drive mechanism can include gears or the like located behind the housing 141 to transfer the power from the motor to the drive rollers. Preferably, the tension rollers 156*a,b* are free spinning, and rotate in response to belt 162 being moved by the rotation of the drive roller 160. It is appreciated, however, that in other configurations, the tension roller 156*a,b* can be associated or connected with the drive mechanism to independently rotate or to act as the drive rollers to drive the belts 162*a,b* along the drive path "C". In other embodiments, multiple cooperating belts can be used against the opposed layers, or rollers can directly guide and operate on the layers past rotating or stationary heaters or other sealing members.

After being fed through the web feed area 164, the first and second web layers 105,107 are sealed together by a sealing assembly 103 and exit the sealing drum 166*a*. In various embodiments, the sealing assembly 103 includes a sealing drum 166*a*. The sealing drum 166*a* includes heating elements, such as thermocouples, which melt, fuse, join, bind, or unite together the two web layers 105,107, or other types of welding or sealing elements.

After the sealing drum 166*a* the first and second web layers 105,107 are cooled allowing the seal to harden by rolling the sealed the first and second web layers 105,107 around a cooling roller 166*b*. The cooling roller 166*b* may act a heat sink or may provide a sufficient cooling time for the heat to dissipate into the air.

Preferably, the web 100 is continuously advanced through the sealing assembly 103 along the material path "E" and past the sealing drum 166*a* at a sealing area 174 to form a continuous longitudinal seal 170 along the web by sealing the first and second web layers 105,107 together, and exits the sealing area 174 at an exit pinch area 178. The exit pinch area 178 is the area disposed downstream the entry pinch area 164 between the belt 162 and the sealing drum 166*a*, as shown in FIG. 7. The sealing area 174 is the area between the entry pinch area 164 and exit pinch area 178 in which the web 100 is being sealed by the sealing drum 166*a*. The longitudinal seal 170 is shown as the phantom line in FIG. 1. Preferably, the longitudinal seal 170 is disposed a transverse distance from the first longitudinal edge 102,106, and most preferably the longitudinal seal 170 is disposed along the mouths 125 of each of the chambers 120.

In the preferred embodiment, the sealing drum 166*a* and one or more of belts 162*a,b* cooperatively press or pinch the first and second web layers 105,107 at the sealing area 174 against the sealing drum 166*a* to seal the two layers together. The sealing assembly 103 may rely on the tension of the belts 162*a,b* against the sealing drum 166*a* to sufficiently press or pinch the web layers 105,107 there between. Although, an abutting roller may be used as well. The flexible resilient material of the belts 162*a,b* allows for the tension of the belts to be well-controlled by the positions of the rollers.

In the embodiment shown, the web 100 enters the sealing assembly at the entry pinch area 176 horizontally. Although in other embodiments the web 100 may enter the sealing assembly at entry to the pinch area that is at a downward angle relative to the horizontal. Additionally, the web 100 exits the sealing assembly 104 at an angle sloped upward with the respect to the horizontal so that the web 100 is exiting facing upwards toward the user. Although, horizontal and downward departures are also contemplated herein.

In accordance with various embodiments, the inflation and sealing device 101 may further include a cutting assembly 186 to cut the web. The cutting assembly 186 may cut the first and second web layers 105,107 between the first longitudinal edge 102 and mouth 125 of the chambers. In some configurations, the cutting assembly 186 may cut the web 100 to open the inflation channel 114 of the web 100 and remove the first and second layers 105,107 from the inflation nozzle 140.

Figure 6:
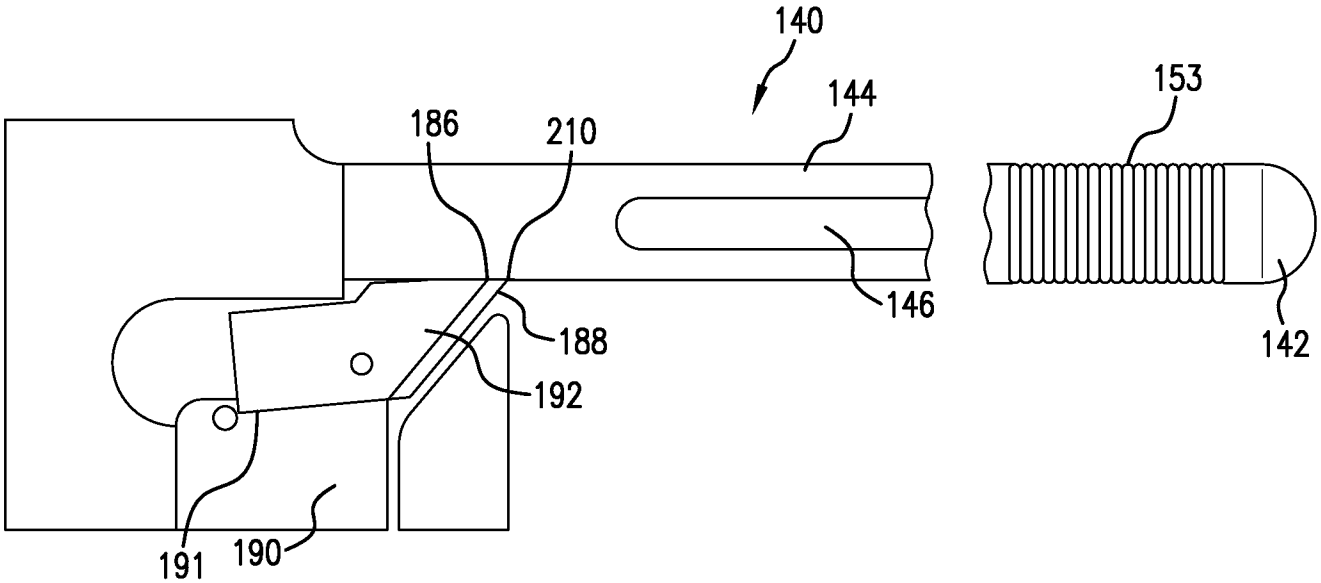
FIG. 6 is a partial view of the cutting assembly in accordance with various embodiments.

As illustrated in FIG. 6, the cutting assembly 186 can include a cutting device or cutting member, such as a blade 192 with a cutting edge 188, and a cutter holder, such as cutter holder 190, mount, or housing member. Preferably, the cutting member is mounted on a holder 190. Preferably, the cutting member is sufficient to cut the web 100 as it is moved past the edge along the material path "E". In the various embodiments, the cutting member is a blade 192 or knife having a sharp cutting edge 188 and a tip 210 at the distal end 196 of the blade 192. In the embodiment shown, the cutting edge 188 is preferably angled upward toward the inflation nozzle 140, although other configurations of the cutting edge 188 can be used.

As shown in FIG. 6, the cutter holder 190 holds the blade 192. This may be done magnetically, with a fastener, or any other method known. The blade 192 may be received within a recessed area 191 of the cutter holder 190. The recessed area 191 preferably having walls to position and align the blade 192 in a fixed position within the cutter holder 190. In various embodiments, the cutting assembly 186 may be a fixed assembly or a movable one such as those described in U.S. application Ser. No. 13/844,658. The blade 192 may engage slot 211 on the nozzle base 144. This engagement may position the blade 192 relative to the nozzle base 144 such that, as the web 100 slides over the nozzle base 144, the web engages the blade 192 and is cut thereby.

The door 218 can further include a door handle 236 to facilitate easy opening of the door 218 when the cutting holder 190 is removed from the inflation and sealing assembly 103 so that a user, for example, can remove the blade 192 from the cutter holder 190. While the embodiment shown shows a door 218, it is appreciated that other embodiments may not include the door 218.

In other embodiments, it's appreciated that a cutter housing 190 can be omitted, and other suitable mechanisms can be used to position the blade 192 adjacent the inflation nozzle 140. Although the cutting assembly 186 is shown, in other embodiments, traditional cutter arrangements can be used, such as a fixed cutter, rotary cutter, or other cutters known in the art.

It is appreciated, that the inflation nozzle 140 described herein can also be used on other types of film handling devices in and inflating and sealing devices. An example is disclosed U.S. Pat. Nos. 8,061,110 and 8,128,770, U.S. Publication No. 2011/0172072, and U.S. application Ser. No. 13/844,658.

Any and all references specifically identified in the specification of the present application are expressly incorporated herein in their entirety by reference thereto. The term "about," as used herein, should generally be understood to refer to both the corresponding number and a range of numbers. Moreover, all numerical ranges herein should be understood to include each whole integer within the range.

While illustrative embodiments of the invention are disclosed herein, it will be appreciated that numerous modifications and other embodiments may be devised by those skilled in the art. For example, the features for the various embodiments can be used in other embodiments. Therefore, it will be understood that the appended claims are intended to cover all such modifications and embodiments that come within the spirit and scope of the present invention.

What is claimed is:

1. A flexible structure inflation and sealing assembly, comprising:

a driver configured for engaging the flexible structure to drive the structure in a downstream direction longitudinally along a material path; and a nozzle including:

an elongated portion having a longitudinal axis aimed generally longitudinally and configured for reception in an inflation channel that extends through the flexible structure, and a fluid conduit including an outlet that directs a fluid from the conduit into the flexible structure;

wherein at least a portion of the nozzle is sufficiently flexible to allow the longitudinal axis of the elongated portion to bend in a transverse, vertical, or combined direction to accommodate variable positions of the flexible structure being fed onto the nozzle.

2. The inflation and sealing assembly of claim 1, wherein the nozzle includes:

a base having an inlet to receive an inflation fluid from a fluid source; and a flexible portion extending from the base and being sufficiently flexible to adapt to variation in a feed angle and a feed direction of the flexible structure.

3. The inflation and sealing assembly of claim 2, wherein the nozzle includes a tip region, wherein the flexible portion connects the base to the tip region and is sufficiently flexible to allow a longitudinal axis in the tip region to move relative to a longitudinal axis defined by the base such that the longitudinal axis in the tip region and the longitudinal axis in the base can move from an aligned orientation to an unaligned orientation.

4. The inflation and sealing assembly of claim 3, wherein the elongated portion extends to the upstream end of the nozzle terminating at the tip region.

5. The inflation and sealing assembly of claim 3, wherein the flexible portion includes a spring material connecting an upstream end of the nozzle base and a downstream end of the tip region.

6. The inflation and sealing assembly of claim 5, wherein the spring material is a coil spring.

7. The inflation and sealing assembly of claim 3, wherein the tip region is a nozzle tip, with the nozzle tip and the nozzle base being discrete structures positioned at separate ends of the flexible portion.

8. The inflation and sealing assembly of claim 2, wherein the nozzle base includes a substantially rigid tube.

9. The inflation and sealing assembly of claim 2, wherein the flexible portion is disposed proximal to or upstream of a pinch area and the flexible structure is fed along the elongated portion to the pinch area.

10. The inflation and sealing assembly of claim 9, wherein the nozzle base extends in an upstream direction of the pinch area.

11. The inflation and sealing assembly of claim 2, wherein a side outlet extends through a wall of the nozzle base.

12. The inflation and sealing assembly of claim 2, wherein a side outlet extends out of the flexible portion.

13. The inflation and sealing assembly of claim 2, wherein substantially the entire nozzle is flexible.

14. The inflation and sealing assembly of claim 2, wherein the flexible portion is more flexible than the nozzle base.

15. The inflation and sealing assembly of claim 2, wherein an upstream end of the nozzle base is closed in a longitudinal direction such that the fluid exits the nozzle before reaching the flexible portion.

16. The inflation and sealing assembly of claim 2, wherein the flexible portion is sufficiently rigid to maintain an orientation of the elongated portion approximately in a direction from which the flexible structure approaches.

17. The inflation and sealing assembly of claim 1, wherein the outlet includes a lateral outlet that is aimed to direct the fluid transversely with respect to the longitudinal axis.

18. The inflation and sealing assembly of claim 1, wherein the nozzle includes a base defining an inlet to receive the fluid into the conduit.

* * * * *